US010791771B2

(12) United States Patent
McFadyen

(10) Patent No.: US 10,791,771 B2
(45) Date of Patent: Oct. 6, 2020

(54) SOCK WITH ELASTIC HEEL

(71) Applicant: No Slip Sox LLC, Germantown, WI (US)

(72) Inventor: Allan W. McFadyen, Germantown, WI (US)

(73) Assignee: NO SLIP SOX, LLC, Germantown, WI (US)

( * ) Notice: Subject to any disclaimer, the term of this patent is extended or adjusted under 35 U.S.C. 154(b) by 46 days.

(21) Appl. No.: 15/935,978

(22) Filed: Mar. 26, 2018

(65) Prior Publication Data

US 2019/0289922 A1 Sep. 26, 2019

(51) Int. Cl.

| | |
|---|---|
| ***A41B 11/00*** | (2006.01) |
| ***A41B 11/06*** | (2006.01) |
| *A41B 11/12* | (2006.01) |
| *A41B 11/02* | (2006.01) |

(52) U.S. Cl.

CPC ..... *A41B 11/003* (2013.01); *A41B 11/06* (2013.01); *A41B 11/008* (2013.01); *A41B 11/02* (2013.01); *A41B 11/126* (2013.01); *A41B 11/128* (2013.01); *A41B 2300/22* (2013.01); *A41B 2300/32* (2013.01); *A41B 2400/82* (2013.01)

(58) Field of Classification Search

CPC ..... A41B 11/003; A41B 11/06; A41B 11/02; A41B 11/126; A41B 11/128; A41B 11/008; A41B 2300/22; A41B 2300/32; A41B 2400/82

USPC ..... 2/240, 241

See application file for complete search history.

(56) References Cited

U.S. PATENT DOCUMENTS

| | | | | |
|---|---|---|---|---|
| 858,006 | A * | 6/1907 | Lum | A41B 11/00 2/239 |
| 3,322,118 | A * | 5/1967 | Sotherlin | A61F 13/069 128/892 |
| 3,648,291 | A * | 3/1972 | Pankers | A61F 13/069 2/16 |
| 3,683,519 | A * | 8/1972 | Creamer | A43B 3/108 36/11.5 |
| 3,990,440 | A * | 11/1976 | Gaylord, Jr. | A61F 13/069 128/892 |
| 4,150,442 | A * | 4/1979 | Boone | A41D 13/06 128/892 |

(Continued)

FOREIGN PATENT DOCUMENTS

| | | |
|---|---|---|
| CN | 2703419 Y | 6/2005 |
| CN | 203575660 U | 5/2014 |

(Continued)

OTHER PUBLICATIONS

Webpage, www.aliexpress/item/Women-s-dew-heel-yoga-socks . . . , dated Feb. 20, 2018, 4 pages.

*Primary Examiner* — Khaled Annis
*Assistant Examiner* — Dakota Marin
(74) *Attorney, Agent, or Firm* — Ryan Kromholz & Manion, S.C.

(57) ABSTRACT

An apparatus is provided for impeding a downward travel of a leg section of a sock by the use of a retainer provided about at least one of a heel of the sock and a heel opening, defined by a heel opening perimeter, of the sock, wherein the retainer impedes the downward travel of the leg section of the sock. A method is provided for the use of the retainer to impede the downward travel of the leg section of the sock.

10 Claims, 7 Drawing Sheets

(56) References Cited

U.S. PATENT DOCUMENTS 4,577,418 A * 3/1986 Nagy ..... A43B 5/007 36/51
4,974,343 A * 12/1990 Davidson ..... A43B 23/17 36/37
5,103,656 A * 4/1992 Hanson, II ..... A41B 11/003 2/239
5,211,035 A * 5/1993 Hanson, II ..... A41B 11/003 66/187
5,419,161 A * 5/1995 Bodenschatz ..... A61F 13/061 2/16
6,142,967 A * 11/2000 Couch ..... A61F 5/0111 602/66
7,107,626 B1 * 9/2006 Andrews ..... A41B 11/004 2/239
D687,155 S 7/2013 Caden
8,572,766 B2 * 11/2013 Shull ..... A41B 11/003 2/239
9,226,842 B2 * 1/2016 Sellitto ..... A61F 5/0127
9,976,237 B2 * 5/2018 Amis ..... A41B 11/003
10,385,486 B2 * 8/2019 Amis ..... D04B 1/108
10,398,584 B2 * 9/2019 Iida ..... A61F 13/066
10,413,479 B2 * 9/2019 Green ..... A61H 39/04
2006/0180159 A1 * 8/2006 Duvoe ..... A41D 13/06 128/892
2007/0192938 A1 * 8/2007 Yoon ..... A41B 11/00 2/239
2009/0151051 A1 * 6/2009 Chen ..... A41B 11/06 2/240
2017/0099883 A1 * 4/2017 Panes, Sr. ..... A41D 17/00
2017/0164661 A1 * 6/2017 Hawkins ..... A41B 11/02

FOREIGN PATENT DOCUMENTS

CN 204617074 U 9/2015
CN 206895837 U 1/2018

* cited by examiner

SOCK WITH ELASTIC HEEL

BACKGROUND OF THE INVENTION

The present invention relates to footwear, more specifically to socks, and more specifically to elastic retainers for socks. Socks are well known in the art. Socks are used for many purposes. This invention relates to the use of socks in covering feet.

A sock may take many forms. This invention involves the following types of socks. The socks comprise a tube section, a foot section and an ankle section located between and connecting the tub section and foot section. The tube section contains a tub section opening in which a foot is inserted. The inserted foot travels the length of the sock until the toes of the foot are in substantial communication with a toe section of the sock.

A sock is used for many purposes. A sock is placed over a foot to protect the foot from the environment. A sock is placed over the foot for comfort. Further, a sock is placed over the foot to act as a means for absorbing certain bodily fluids, such as perspiration.

Socks may incorporate various features as well. In particular socks may incorporate areas of compression. Prior art socks have incorporated areas of compression for therapeutic purposes. Prior in socks have incorporated metallic components for the purpose of therapeutic effects to the body parts covered by the sock. Unlike the prior art, socks, this invention does claim a therapeutic benefit.

Additionally, socks may incorporate various toe section features. Prior art socks have incorporated an open toe section where the user's toes are exposed through the open end of the toe section. Further, prior art socks have incorporated the open toe section with individual ports for each toe of the foot. Unlike the prior art shoes, this invention does not claim an open toes section. Further, this section does not claim an open toe section in combination with individual ports for each toe of the foot.

Prior art socks claim a buffering layer located at a second side, or ground direction side, of the foot section of the sock for abrasion resistance. Such prior art may incorporate a multi-layer buffer to increase wear resistance for the sock. Unlike the prior art shoes, this invention does not claim a benefit of wear resistance.

Certain prior art socks disclose a sock lacking a tub section, and reducing the potential of the sock sliding off. Specifically, Chinese publication no. 203575660 discloses an invisible sock or boat sock. The invisible sock contains an opening at the heel and an opening on the top of the invisible sock for insertion of a foot. The invention resists falling off the foot thru the use of a hook portion of the invisible sock which rests above the heel. The present invention is distinguished from Chinese publication no. 203575660 due to the fact Chinese publication no. 203575660 specifically teaches away from the use of a restraining mechanism on a tube sock. In fact, the disclosure states an objective of the invention is to provide hook socks while being efficient with materials. The present invention is to tube socks, which the Chinese publication no. 203575660 specifically teaches away from. Further, the present invention is to an apparatus and method for restraining movement of the tube section of the sock. Chinese publication no, 203575660 does not teach such a restraining mechanism due to the fact the publication teaches away from tube socks.

A need exists for an apparatus to restrain the downward movement of leg sections of socks, in particular tube socks.

A need exists for an apparatus which provides functional gripping about a body appendage to restrain downward movement of socks, in particular tube socks.

A need exists for a method which restrains downward movement of lee sections of socks, particularly tube socks.

SUMMARY OF THE INVENTION

Briefly, the invention relates to an apparatus and method for restraining downward movement of socks, and more specifically restraining the downward movement of leg sections of socks, particularly tube socks.

A first embodiment of the sock comprising a leg section, an ankle section, and a foot section in communication. The leg section is in communication with the ankle section at an ankle section first end. The foot section in communication with the ankle section at an ankle section second end. The ankle section having a heel. An at least one retainer having a perimeter about the heel, wherein the retainer provides a compressive force impeding a downward travel of the leg section.

The first embodiment of the sock further comprising the at least one retainer comprised of an elastic material. The first embodiment of the sock further comprising the perimeter is at least one of a continuous perimeter and a discontinuous perimeter. The first embodiment of the sock further comprising the at least one retainer may provide for at least one of a first region of compressive force and a second region of compressive force. The first embodiment of the sock further comprising the perimeter in communication with the heel. The first embodiment of the sock further comprising the perimeter in communication with the heel and a foot section bottom. The first embodiment of the sock further comprising the at least one retainer in at least one of fixed communication and removable communication with the first embodiment of the sock.

A second embodiment of the sock comprising a leg section, an ankle section, and a foot section in communication. The leg section in communication with the ankle section at an ankle sections first end. The foot section in communication with the ankle section at an ankle section second end. The ankle section having a heel opening defined by a heel opening perimeter. An at least one retainer having a perimeter about the heel opening perimeter, wherein the retainer provides a compressive force impeding a downward travel of the leg section.

The second embodiment of the sock further comprising the at least one retainer comprised of an elastic material. The second embodiment of the sock further comprising the perimeter is at least one of a continuous perimeter and a discontinuous perimeter. The second embodiment of the sock further comprising the perimeter in communication with the heel opening perimeter. The second embodiment of the sock further comprising the perimeter in communication with the heel opening perimeter and a foot section bottom. The second embodiment of the sock, further comprising the at least one retainer in at least one of fixed communication and removable communication with the sock.

A method of using the sock comprising a leg section, an ankle section, and a foot section in communication. The leg section in communication with the ankle section at an ankle section first end. The foot section in communication with the ankle section at an ankle section second end. The ankle section having at least one of a heel and a heel opening defined by a heel opening perimeter. An at least one retainer having a perimeter about at least one of the heel and the heel opening defined by the heel opening perimeter. The at least one retainer placing a compressive force on a body appendage. Further, traveling a body appendage contained by the sock and a shoe. Subsequently, the leg section traveling in a direction of the shoe. While, the at least one retainer is providing the compressive force and is impeding a travel of the leg section.

An intended benefit of the invention is an apparatus to restrain the downward movement of leg sections of socks, in particular tube socks. An intended benefit of the invention is an apparatus which provides functional gripping about a body appendage to restrain downward movement of socks, in particular tube socks.

The method further comprising the leg section traveling down the body appendage in a direction of the shoe. The method further comprising the leg section ceasing a travel. The method further comprising placing the body appendage in the sock, wherein the heel appendage resides within at least one of the heel and the heel opening defined by the heel opening perimeter. The method further comprising the leg section traveling towards at least one of the heel and the heel opening defined by the heel opening perimeter. The method further comprising the travel of the leg section ending in close proximity to a top of the shoe.

An intended benefit of the invention is a method which restrains downward movement of leg sections of socks, particularly rube socks.

DESCRIPTION OF THE PREFERRED EMBODIMENT

Figure 1:
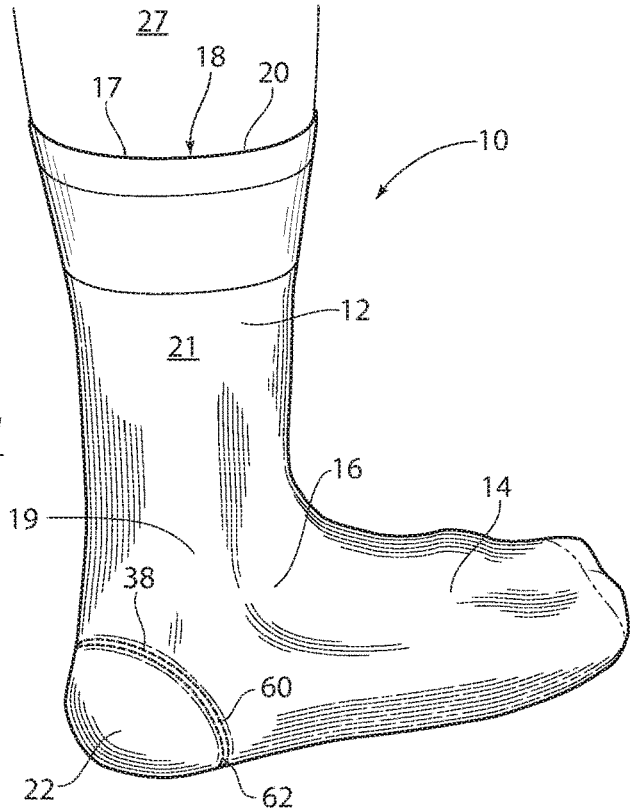
FIG. 1 is to a perspective view of a first embodiment of the invention.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

With respect to FIGS. 1, 2, 3 and 4, a first embodiment of the invention is illustrated. The invention comprises a sock 10. The sock 10 comprises a leg section 12, an ankle section 16 and a foot section 14. The leg section 12 comprises a leg section first end 17 and an oppositely opposed leg section second end 19. A leg section tubular section 21 resides between the leg section first end 17 and the leg section second end 19. The leg section first end 17 provides for an opening 18. The opening 18 is defined by an opening rim 20. The opening rim 20 preferably defines the perimeter of the opening 18. The opening 18 preferably comprises at least substantially all of the leg section first end 17. Alternatively, the opening 18 may comprise less than substantially all of the leg section first end 17. The opening 18 is defined wherein a body appendage, such as a foot and/or leg 27, may be inserted in the opening 18.

Figure 2:
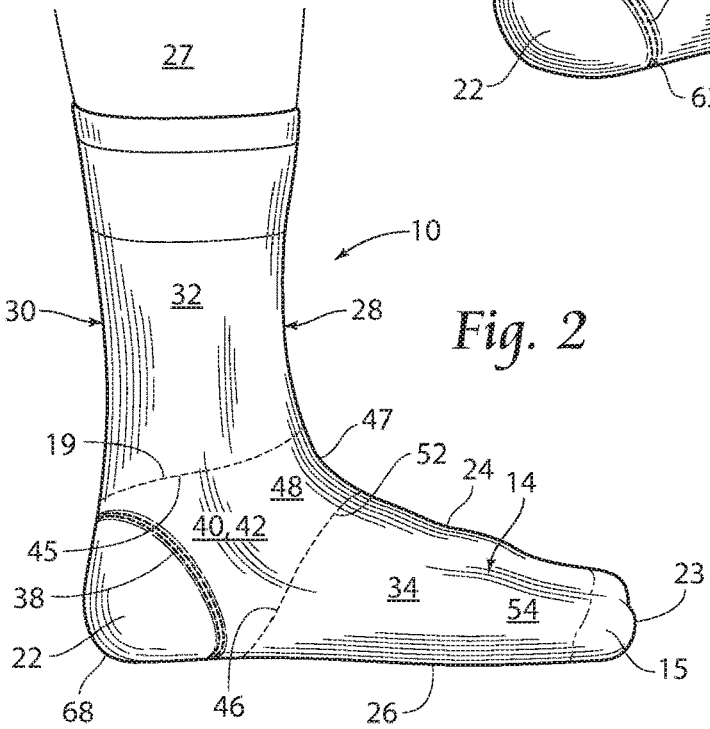
FIG. 2 is to a side view of the first embodiment of the invention.

As illustrated in FIG. 2, a side view of the first embodiment of the invention, the leg section tubular section 21 is defined by a leg section front 28, a leg section back 30, and an at least one leg section side 32 separating the leg section front 28 from the leg section back 30. The leg section front 28, the leg section back 30, and the at least one leg section sides 32 are oriented to create the leg section tubular section 21 defined by the leg section first end 17 and the leg section second end 19. Wherein upon the body appendage, such as a foot and/or leg 27, being inserted in the opening 18, the body appendage, such as a foot and/or leg 27, travels within the leg section tubular section 21 to the leg section second end 19.

The leg section second end 19 is in communication with the ankle section 16. The ankle section comprises an ankle section first end 45 and an oppositely opposed ankle section second end 46. An ankle section tubular section 48 resides between the ankle section first end 45 and the ankle section second end 46. The ankle section first end 45 provides for an ankle section first end opening (not illustrated in the figures). The ankle section first end opening (not illustrated in the figures) is in communication with a leg section second end opening (not illustrated in the figures) where the leg section second end 19 communicates with the ankle section first end 45. It is noted, the communication between the leg section second end 19 and the ankle section first end 45 may be may vary in location on the sock 10.

The ankle section tubular section 48 is defined by an ankle section front 47, a heel 22, an at least one ankle section first side 40, and an at least one ankle section second side 42. The at least one ankle section first side 40 and the at least one ankle section second side 42 provide for separation between the ankle section front 47 and the heel 22. The ankle section front 47, the heel 22, the at least one ankle section first side 40 and the at least one ankle section second side 42 are oriented to create the ankle section tubular section 48. The ankle section tubular section 48 is defined by the ankle section first end 45 and the ankle section second end 46.

Figure 3:
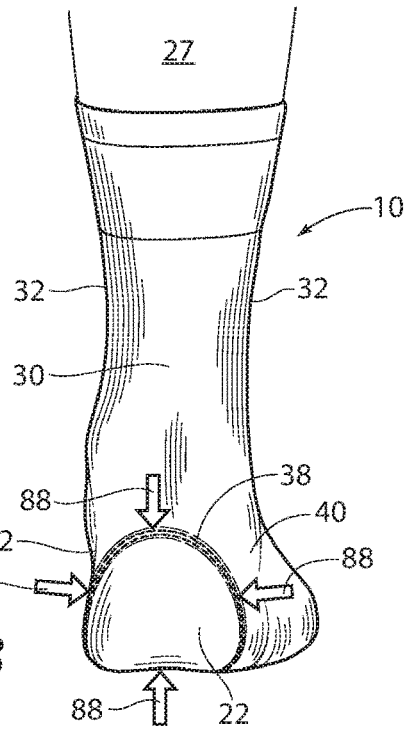
FIG. 3 is to a rear view of the first embodiment of the invention.
Figure 4:
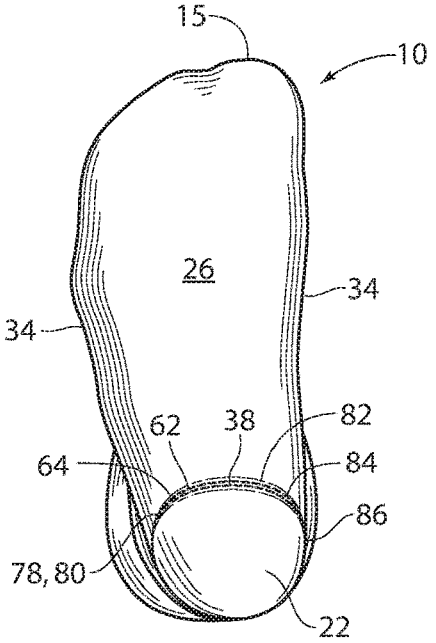
FIG. 4 is to a bottom view of the first embodiment of the invention.

As illustrated in FIG. 2 and FIG. 3, the ankle section 16 and the leg section 12 are positioned such that the leg section back 30 is adjoined to the heel 22. The ankle section 16 and the leg section 12 are positioned such that the leg section front 28 is adjoined to the ankle section front 47. The ankle section 16 and the leg section 12 are positioned such that the at least one leg section side 32 is adjoined to the ankle section first side 40. The ankle section 16 and the leg section 12 are positioned such that the at least one leg section side 32 is adjoined to the ankle section second side 42. Where in a tubular section (not illustrated in the figures) is defined by the communication between the leg section 12 and the ankle section 16. Wherein upon the body appendage, such as a foot and/or leg 27, travels beyond the leg section second end 19, thru the ankle section tubular section 48 to the ankle section second end 42.

As illustrated in FIGS. 1, 2, 3 and 4, the foot section 14 comprises a foot section first end 52 and an oppositely opposed toe section 15. The toe section 15 may be a closed toe section 23. A foot section tubular section 54 resides between and is defined by the foot section first end 52 and the toe section 15. A foot section tubular section 54 resides between the foot section first end 52 and the toe section 15. The toe section first end 52 provides for a toe section first end opening (not illustrated in the figures). The toe section first end opening (not illustrated in the figures) is in communication with an ankle section second end opening (not illustrated in the figures) where the ankle section second end 46 communicates with the toe section first end 52. It is noted, the communication between the ankle section second end 46 and the toe section first end 52 may be may vary in location on the sock 10.

The foot section tubular section 54 is defined by a foot section top 24, a foot section bottom 26, and at least one foot section side 34. The at least one foot section side 34 provides for separation between the foot section top 24 and the foot section bottom 26. The foot section top 24, the foot section bottom 26, and the at least one foot section side 34 are oriented to create the foot section tubular section 54.

The ankle section 16 and the foot section 14 are positioned such that the ankle section front 47 is adjoined to the foot section top 24. The ankle section 16 and the foot section 14 are positioned such that the heel 22 is adjoined to the foot section bottom 26. The ankle section 16 and the foot section 14 are positioned such that the at least one foot section side 34 is adjoined to the ankle section first side 40. The ankle section 16 and the foot section 14 are positioned such that the at least one foot section side 34 is adjoined to the ankle section second side 42. Where in a tubular section (not illustrated in the figures) is defined by the communication between the ankle section 16 and the foot section 14. Wherein upon the body appendage, such as a foot and/or leg 27, travels beyond the ankle section second end 46, thru the foot section tubular section 54 to the toe section 15. Wherein, an appendage heel 50 rests in the heel 22 of the sock 10.

Figure 12:
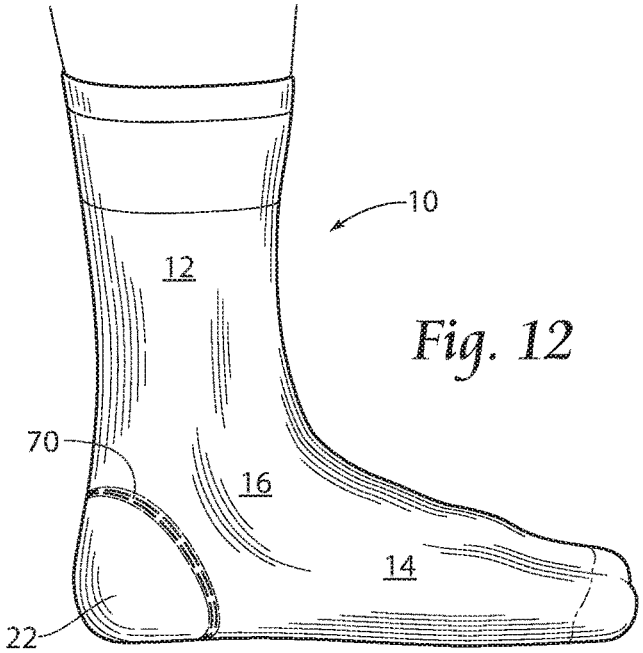
FIG. 12 is a side view of the first embodiment of the invention illustrating a discontinuous perimeter.
Figure 14:
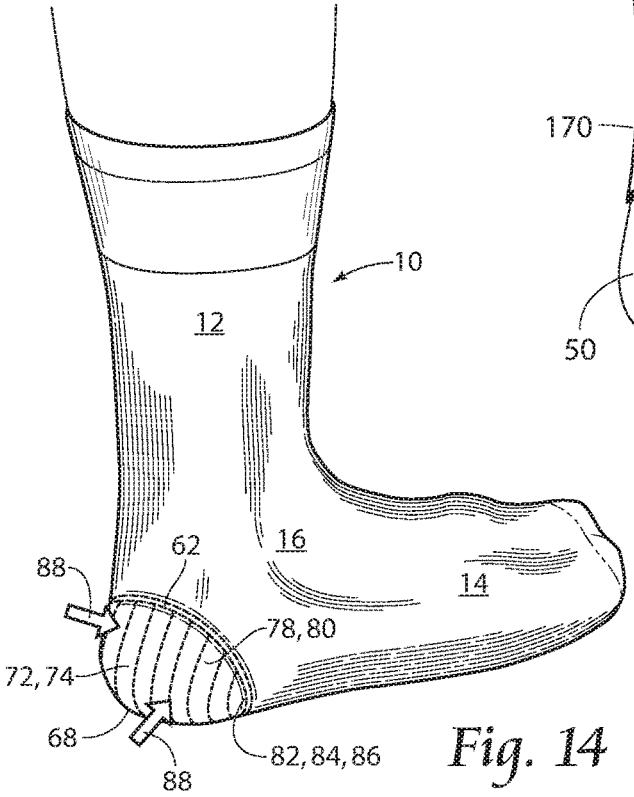
FIG. 14 is a perspective view of the first embodiment of the invention illustrating at least one of a first region of compressive force and a second region of compressive force.

As illustrated in FIGS. 1, 2, 3, 4, 12, 14, and 15, in proximity to the heel 22 of the sock 10, an at least one retainer 38 comprises a perimeter 62 about the heel 22. The at least one retainer 38 preferably comprises the perimeter 62 which is a continuous perimeter 64 about the heel 22. Alternatively, as illustrated in FIG. 12, the at least one retainer 38 may comprise the perimeter 62 which is a discontinuous perimeter 70 about the heel 22. At least one of the at least one retainer 38 preferably provides for a compressive force 88 about the body appendage, such as a foot and/or leg 27, in substantial proximity to the perimeter 62. As illustrated in FIG. 3, the compressive force 88 is preferably provide from at least substantially all the at least one retainer 38. Alternatively, the at least one retainer 38 may provide for a first region of compressive force 72, about the body appendage, such as a foot and/or leg 27, in substantial proximity to the perimeter 62 and extending towards a heel end 68. Alternatively, the at least one retainer 38 may provide for a second region of compressive force 74, about the body appendage, such as a foot and/or leg 27, in substantial proximity to the perimeter 62 and extending towards, and in substantial proximity to, the heel end 68. As illustrated in FIG. 14, in the case of the at least one retainer 38 providing for the first region of compressive force 72 or the second region of compressive force 74, the compressive force 88 is preferably provided on at least substantially all of the first region of compressive force 72 or at least substantially all of the second region of compressive force 74.

Figure 15:
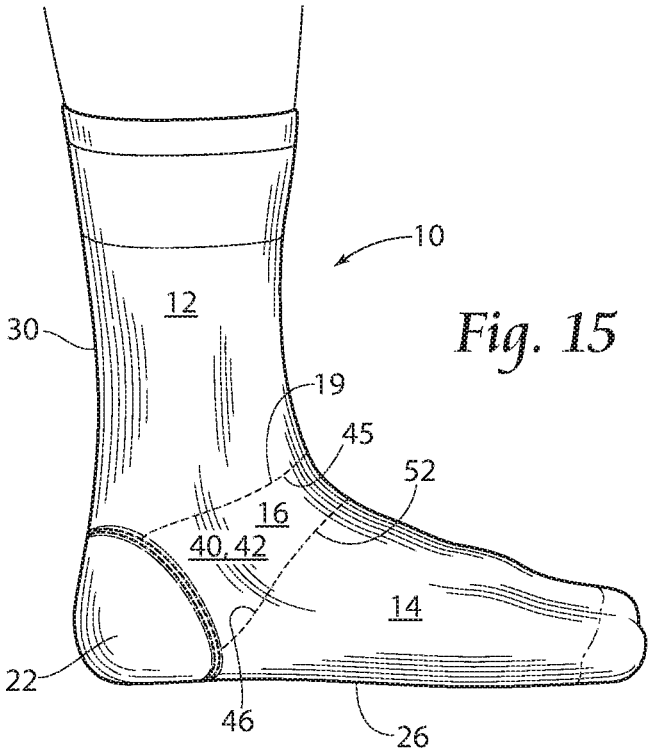
FIG. 15 is a side view of the first embodiment of the invention.
Figure 16:
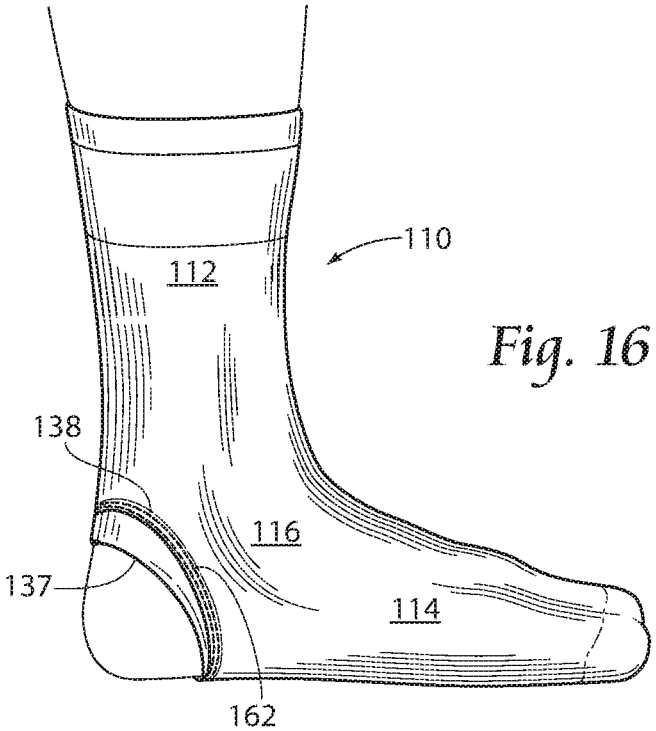
FIG. 16 is a side view of the second embodiment of the invention illustrating a perimeter of an at least one retainer in at least partial communication with a heel opening perimeter.
Figure 17:
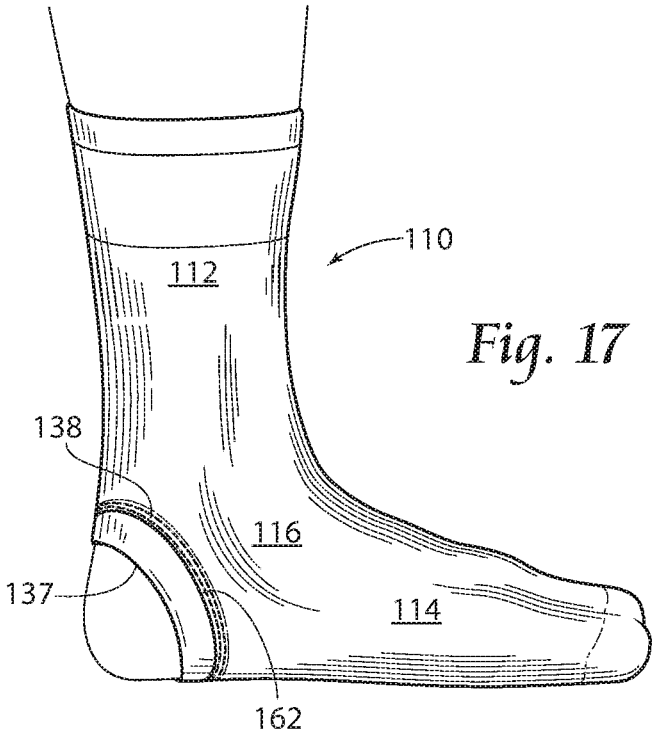
FIG. 17 is a side view of the second embodiment of the invention illustrating the perimeter of the at least one retainer offset from the heel opening perimeter.
Figure 18:
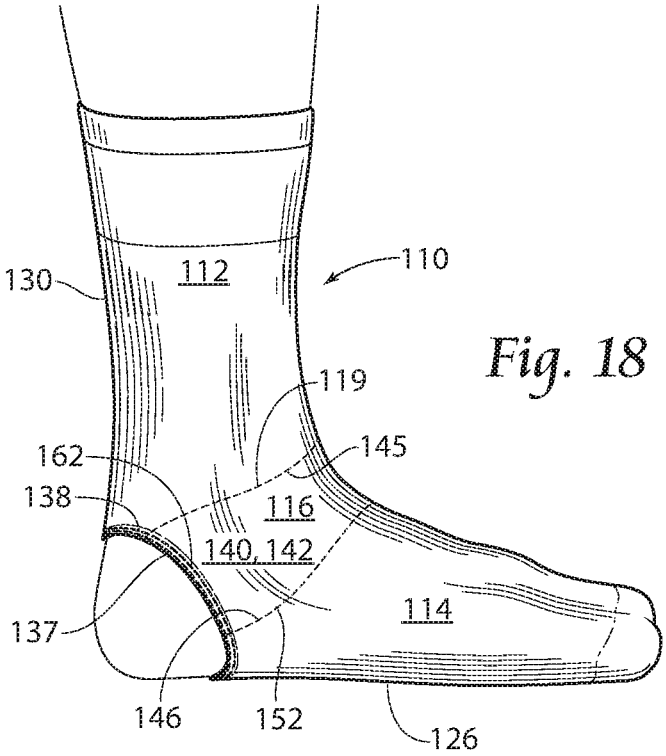
FIG. 18 is a side view of the second embodiment of the invention.

The at least one retainer 38 has a location 60 such that the perimeter 62 of the at least one retainer 38 is preferably in communication with the heel 22. Alternatively, as illustrated in FIG. 15, the at least one retainer 38 has a location 60 such that the perimeter 62 of the at least one retainer 38 may be in communication with at least one of the heel 22 and the foot section bottom 26. Alternatively, as illustrated in FIG. 15, at least one of the at least one retainer 38 may have a location 60 such that the perimeter 62 of the at least one retainer 38 may be in communication with a combination of at least one of the heel 22, the leg section second end 19, the leg section back 30, the at least one leg section side 32, the leg section tubular section 21, the ankle section first end 45, the ankle section second end 46, the ankle section first side 40, the ankle section second side 42, the ankle section tubular section 48, the foot section first end 52, the foot section bottom 26, the at least one foot section side 34, and the foot section tubular section 54.

The at least one retainer 38 preferably comprises elastic material. Alternatively, the at least one retainer 38 may comprise non-elastic material. Alternatively, the at least one retainer 38 may comprise at least one of elastic material and non-elastic material.

The at least one retainer 38 is preferably in fixed communication 78 with the sock 10. Alternatively, the at least one retainer 38 may be in removable communication 80 with the sock 10.

The at least one retainer 38 is preferably in seamed communication 82 with the sock 10, for example stitching. Alternatively, the at least one retainer 38 may be in welded communication 84 with the sock 10. Alternatively, the at least one retainer 38 may be in hook-and-loop communication 86 with the sock 10.

Wherein, the compressive force 88 of the retainer 38 impedes the downward progression of the leg section 12 of the sock 10.

Figure 5:
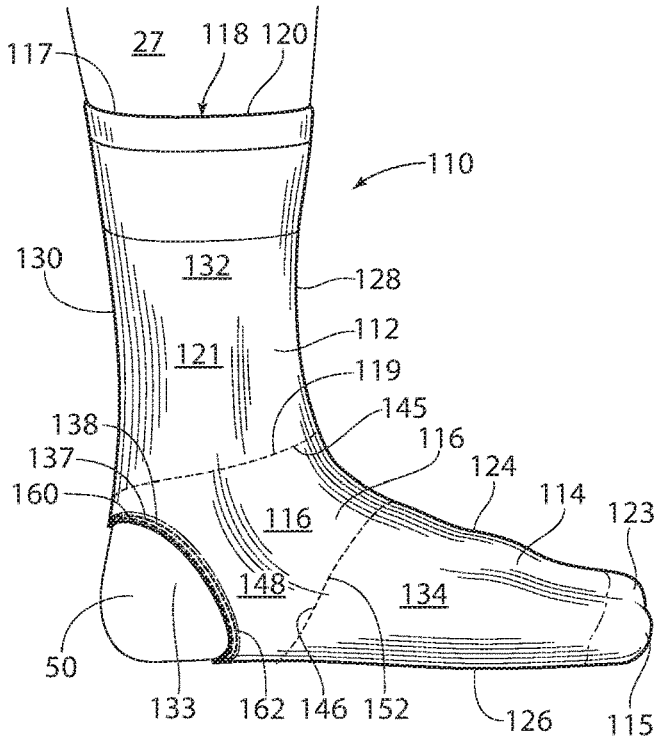
FIG. 5 is to a side view of the second embodiment of the invention.
Figure 6:
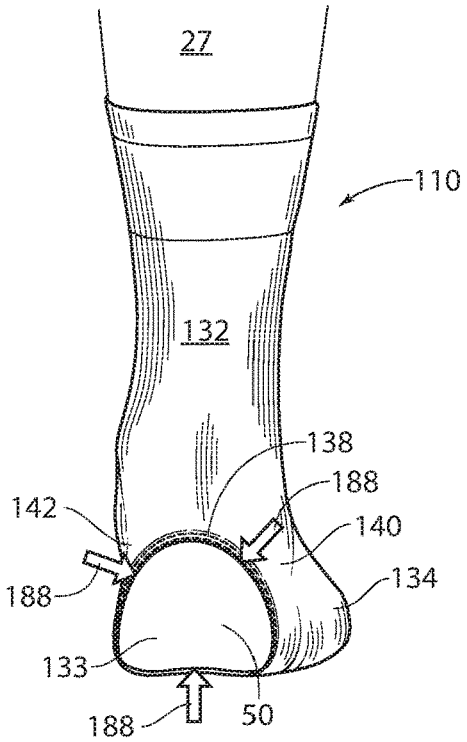
FIG. 6 is to a rear view of the second embodiment of the invention.
Figure 7:
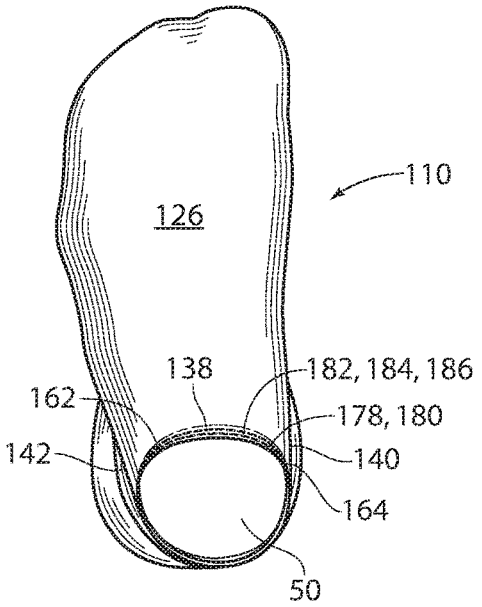
FIG. 7 is to a bottom view of the second embodiment of the invention.
Figure 8:
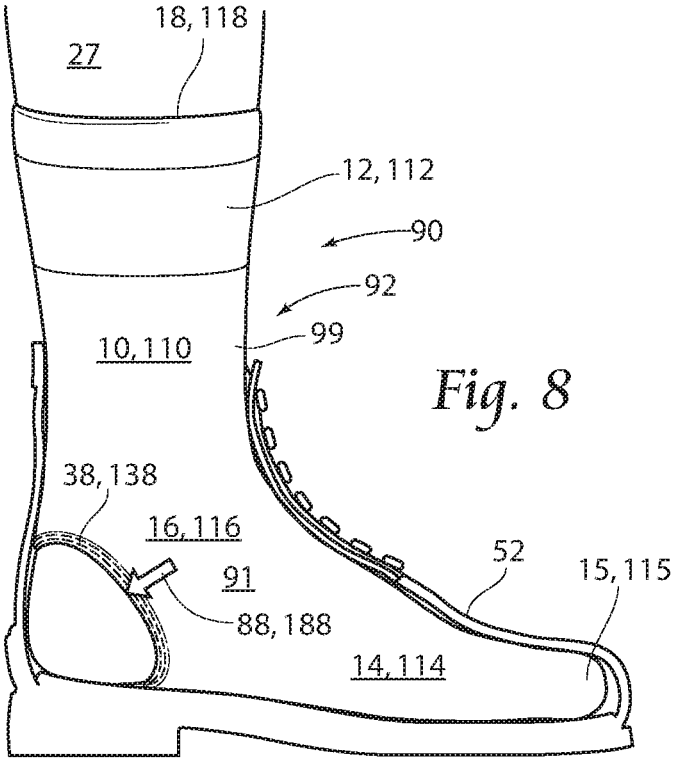
FIG. 8 is a side view of a method for applying the invention illustrating the invention prior to movement.
Figure 9:
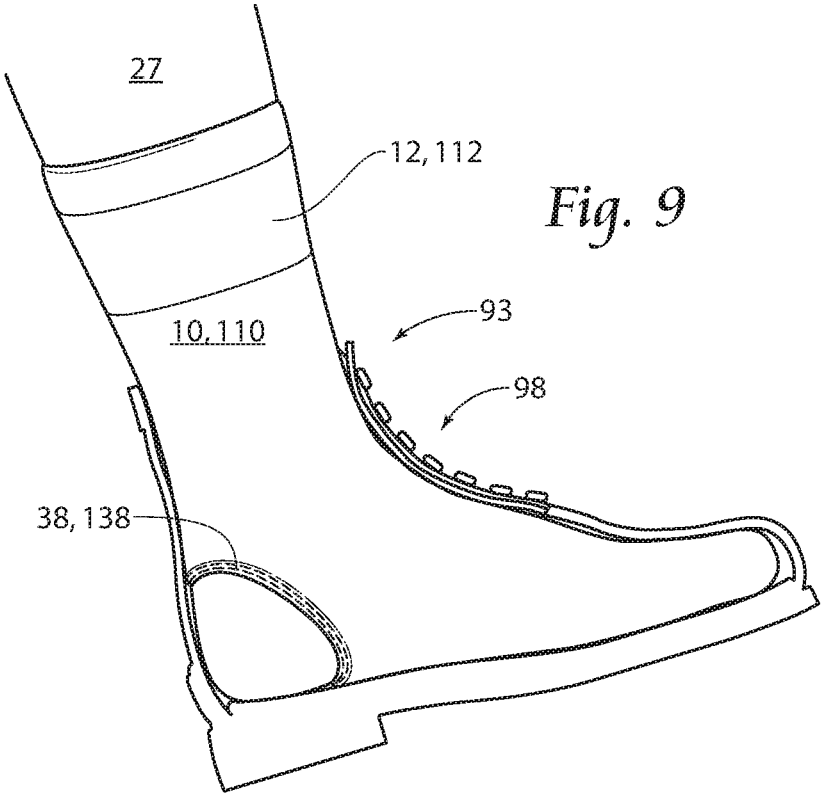
FIG. 9 is the side view of the method for applying the invention illustrating the invention during movement.
Figure 10:
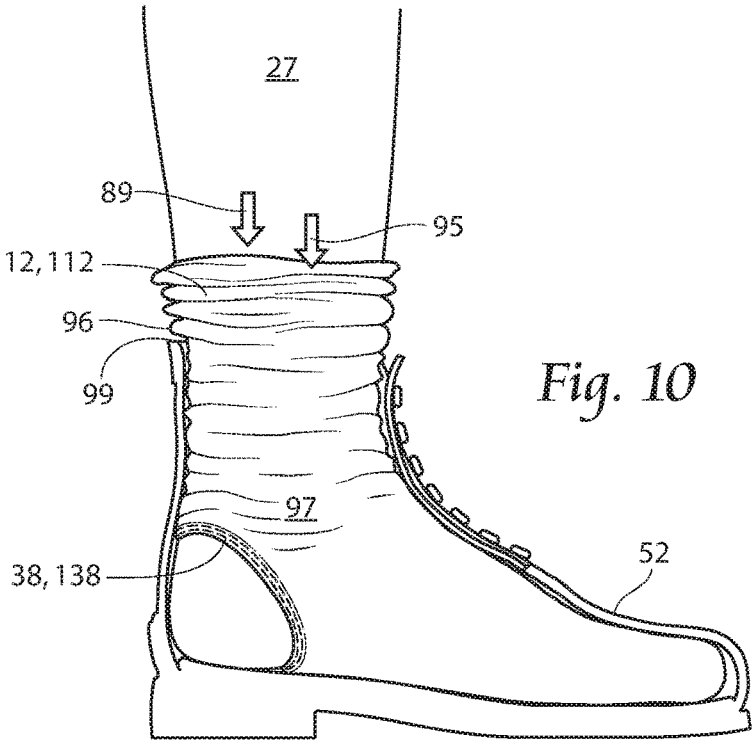
FIG. 10 is the side view of the method for applying the invention illustrating the downward movement of a leg section of the invention.
Figure 11:
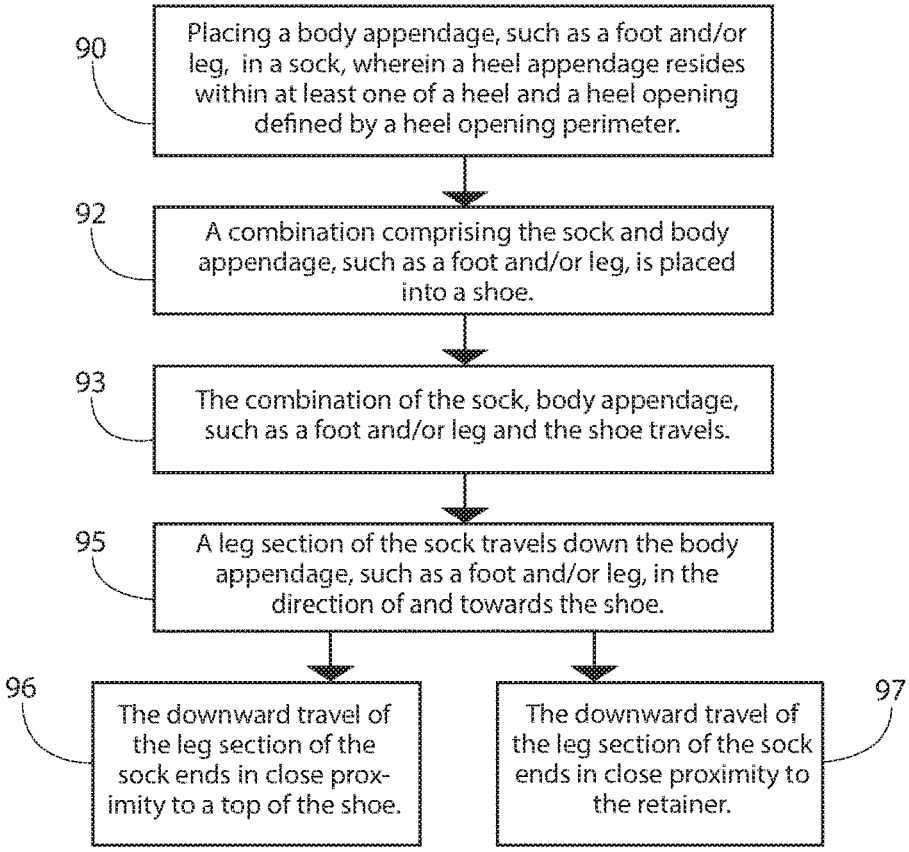
FIG. 11 is flowchart of the method for applying the invention.

With respect to FIGS. 5, 6, 7, a second embodiment of the invention is illustrated. The invention comprises a sock 110. The sock 110 comprises a leg section 112, an ankle section 116 and a foot section 114. The leg section 112 comprises a leg section first end 117 and an oppositely opposed leg section second end 119. A leg section tubular section 121 resides between the leg section first end 117 and the leg section second end 119. The leg section first end 117 provides for an opening 118. The opening 118 is defined by an opening rim 120. The opening rim 120 preferably defines the perimeter of the opening 118. The opening 118 preferably comprises at least substantially all of the leg section first end 117. Alternatively, the opening 118 may comprise less than substantially all of the leg section first end 117. The opening 118 is defined wherein a body appendage, such as a foot and/or leg 27, may be inserted in the opening 118.

As illustrated in FIG. 5, a side view of the second embodiment of the invention, the leg section tubular section 121 is defined by a leg section front 128, a leg section back 130, and an at least one leg section side 132 separating the leg section front 28 from the leg section back 130. The leg section front 128, the leg section back 130, and the at least one leg section sides 132 are oriented to create the leg section tubular section 121 defined by the leg section first end 117 and the leg section second end 119. Wherein upon the body appendage, such as a foot and/or leg 27, being inserted in the opening 118, the body appendage, such as a foot and/or leg 27, travels within the leg section tubular section 121 to the leg section second end 119.

The leg section second end 119 is in communication with the ankle section 116. The ankle section comprises an ankle section first end 145 and an oppositely opposed ankle section second end 146. An ankle section tubular section 148 resides between the ankle section first end 145 and the ankle section second end 146. The ankle section first end 145 provides for an ankle section first end opening (not illustrated in the figures). The ankle section first end opening (not illustrated in the figures) is in communication with a leg section second end opening (not illustrated in the figures) where the leg section second end 119 communicates with the ankle section first end 145. It is noted, the communication between the leg section second end 119 and the ankle section first end 145 may be may vary in location on the sock 110.

The ankle section tubular section 148 is defined by an ankle section front 147, a heel opening 133, heel opening perimeter 137, an at least one ankle section first side 140, and an at least one ankle section second side 142. The heel opening 133 is defined by the heel opening perimeter 137. The at least one ankle section first side 140 and the at least one ankle section second side 142 provide for separation between the ankle section front 147 and the heel opening perimeter 137. The ankle section front 147, the heel opening perimeter 137, the heel opening 133, the at least one ankle section first side 140 and the at least one ankle section second side 142 are oriented to create the ankle section tubular section 148. The ankle section tubular section 148 is defined by the ankle section first end 145 and the ankle section second end 146.

As illustrated in FIGS. 5 and 6, the ankle section 116 and the leg section 112 are positioned such that the leg section back 130 is adjoined to the heel opening perimeter 137. The ankle section 116 and the leg-section 112 are positioned such that the leg section front 128 is adjoined to the ankle section front 147. The ankle section 116 and the leg section 112 are positioned such that the at least one leg section side 132 is adjoined to the ankle section first side 140. The ankle section 116 and the leg section 112 are positioned such that the at least one leg section side 132 is adjoined to the ankle section second side 142. Where in a tubular section (not illustrated in the figures) is defined by the communication between the leg section 112 and the ankle section 116. Wherein upon the body appendage, such as a foot and/or leg 27, travels beyond the leg section second end 119, thru the ankle section tubular section 148 to the ankle section second end 142.

As illustrated in FIGS. 5, 6 and 7, the foot section 114 comprises a foot section first end 152 and an oppositely opposed toe section 115. The toe section 115 may be a closed toe section 123. A foot section tubular section 154 resides between and is defined by the foot section first end 152 and the toe section 115. A foot section tubular section 154 resides between the foot section first end 152 and the toe section 115. The toe section first end 152 provides for a toe section first end opening (not illustrated in the figures). The toe section first end opening (not illustrated in the figures) is in communication with an ankle section second end opening (not illustrated in the figures) where the ankle section second end 146 communicates with the toe section first end 152. It is noted, the communication between the ankle section second end 146 and the toe section first end 152 may be may vary in location on the sock 110.

The foot section tubular section 154 is defined by a foot section top 124, a foot section bottom 126, and at least one foot section side 134. The at least one foot section side 134 provides for separation between the foot section top 24 and the foot section bottom 126. The foot section top 124, the foot section bottom 126, and the at least one foot section side 134 are oriented to create the foot section tubular section 154.

The ankle section 116 and the foot section 114 are positioned such that the ankle section front 147 is adjoined to the foot section top 124. The ankle section 116 and the foot section 114 are positioned such that the heel opening perimeter 137 is adjoined to the foot section bottom 126. The ankle section 116 and the foot section 114 are positioned such that the at least one foot section side 134 is adjoined to the ankle section first side 140. The ankle section 116 and the foot section 114 are positioned such that the at least one foot section side 134 is adjoined to the ankle section second side 142. Where in a tubular section. (not illustrated in the figures) is defined by the communication between the ankle section 116 and the foot section 114. Wherein upon the body appendage, such as a foot and/or leg 27, travels beyond the ankle section second end 146, thru the foot section tubular section 154 to the toe section 115. Wherein, an appendage heel 50 rests in the heel opening 133 of the sock 110.

Figure 13:
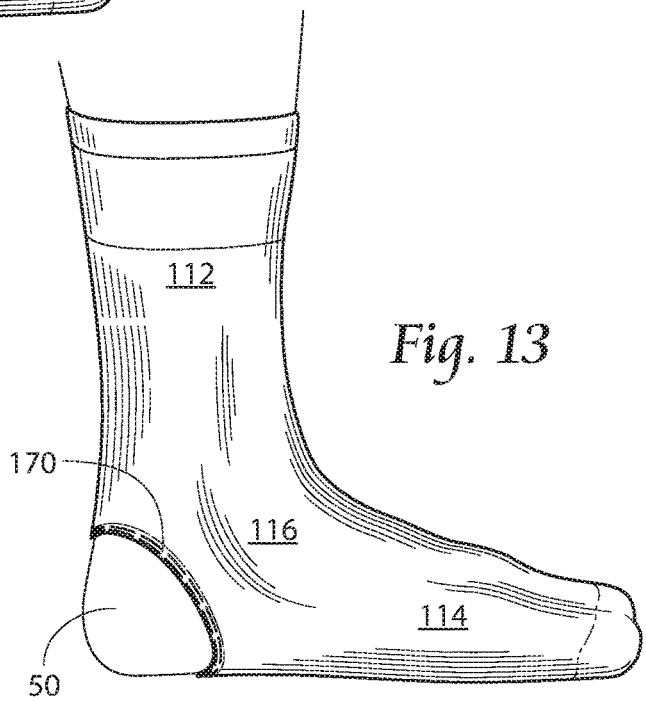
FIG. 13 is to a side view of the second embodiment of the invention illustrating a discontinuous perimeter.

As illustrated in FIGS. 5, 6, 7, 13, 16, 17 and 18, in proximity to the heel opening perimeter 137 of the sock 110, an at least one retainer 138 comprises a perimeter 162 about the heel opening perimeter 137. The at least one retainer 138 preferably comprises the perimeter 162 which is a continuous perimeter 164 about the heel opening perimeter 137. Alternatively, as illustrated in FIG. 13, the at least one retainer 138 may comprise the perimeter 162 which is a discontinuous perimeter 170 about the heel opening perimeter 133. The at least one retainer 138 preferably provides for a compressive force 188 about the body appendage, such as a foot and/or leg 27, in substantial proximity to the perimeter 162. As illustrated in FIG. 6, the compressive force 188 is preferably provided from at least substantially all the at least one retainer 138.

The at least one retainer 138 has a location 160 such that the perimeter 162 of the at least one retainer 138 is preferably in substantial communication with the heel opening perimeter 137. Alternatively, as illustrate in FIG. 16, at least one of the at least one retainer 138 has a location 160 such that the perimeter 162 of the at least one retainer 138 may be in at least partial communication with the heel opening perimeter 137. Alternatively, as illustrate in FIG. 17, at least one of the at least one retainer 138 has a location 160 such that the perimeter 162 of the at least one retainer 138 may be offset from the heel opening perimeter 137.

In such orientations, the at least one retainer 138 has a location 160 such that the perimeter 162 of the at least one retainer 138 is preferably in substantial communication with the heel opening perimeter 137. Alternatively, at least one of the at least one retainer 138 may have a location 160 such that the perimeter 162 of the at least one retainer 138 may be in communication with the heel opening perimeter 137 and the foot section bottom 126. Alternatively, as illustrate in FIG. 18, at least one of the at least one retainer 138 may have a location 160 such that the perimeter 162 of the at least one retainer 138 may be in communication with a combination of at least one of the heel opening 133, heel opening perimeter 137, the leg section second end 119, the leg section back 130, the at least one leg section side 132, the leg section tubular section 121, the ankle section first end 145, the ankle section second end 146, the ankle section side 140, the ankle section second side 142, the ankle section tubular section 148, the foot section first end 152, the foot section bottom 126, the at least one foot section side 134, and the foot section tubular section 154.

The at least one retainer 138 preferably comprises elastic material. Alternatively, the at least one retainer 138 may comprise non-elastic material. Alternatively, the at least one retainer 138 may comprise at least one of elastic material and non-elastic material.

The at least one retainer 138 is preferably in fixed communication 178 with the sock 110. Alternatively, the at least one retainer 38 may be in removable communication 180 with the sock 110.

The at least one retainer 138 is preferably in seamed communication 182 with the sock 110, for example stitching. Alternatively, the at least one retainer 138 may be in welded communication 184 with the sock 110. Alternatively, the at least one retainer 138 may be in hook-and-loop communication 86 with the sock 110.

Wherein, the compressive force 188 of the retainer 138 impedes the downward progression of the leg section 112 of the sock 110. The invention provides an intended benefit of an apparatus to restrain the downward movement of leg sections (112, 112) of socks (10, 110), in particular tube socks. The invention provides an intended benefit which is an apparatus that provides functional gripping about a body appendage to restrain downward movement of socks, in particular tube socks.

With respect to FIGS. 8, 9, 10 and 11, a method of operating the invention for a sock (10, 138) with a retainer (38, 138) comprises the following. A body appendage, such as a foot and/or leg 27, is preferably placed into an opening (18, 118) of the leg section first end (12, 112) of the sock (10, 110). The body appendage, such as a foot and/or leg 27 traverses through the tubular section 91 created by the communication of the log section (12, 112), ankle section (16, 116), and foot section (14, 114) of the sock (10, 110). The travel the body appendage, such as a foot and/or leg 27, halts when a portion of the body appendage, such as a foot and/or leg 27 is in substantial proximity to the toe section (15, 115). At this point, the heel appendage 50 of the body appendage, such as a foot and/or leg 27, resides within at least one of the heel 22 and the heel opening 133 defined by the heel opening perimeter 137, 90. The retainer (38, 138) of the sock (10, 110) places a compressive force (88, 188) on a predetermined location of the body appendage, such as a foot and/or leg 27.

A combination 99 comprising the sock 10, 110 and body appendage, such as a foot and/or leg 27 is placed into a shoe 52 as known in the art, 92, creating a combination 98 of the sock (10, 110), body appendage, such as a foot and/or leg 27 and the shoe 52. The combination comprises the body appendage, such as a foot and/or leg 27 contained by the sock (10, 110) and the shoe 52.

The combination 98 of the sock (10, 110), body appendage, such as a foot and/or leg 27 and the shoe 52 travels, 93. The leg section (12, 112) of the sock (10, 110) travels down the body appendage, such as a foot and/or leg 27 in the direction 89 of and towards the shoe 52, 95 and towards at least one of the heel 22 and the heel opening 133 defined by the heel opening perimeter 137. The leg section (12, 112) of the sock (10, 110) cease the downward travel 95, because the compressive force (88, 188) of the retainer (38, 138) impedes the downward travel 95 of the leg section (12, 112) of the sock (10, 110). The downward travel 95 of the leg section (12, 112) of the sock (10, 110) preferably ends in close proximity to a top 99 of the shoe 52, 96. Alternatively, the downward travel 95 of the leg section (12, 112) of the sock (10, 110) may end in close proximity to the retainer (38, 138), 96. The invention provides an intended benefit of a method which restrains downward movement of leg sections (12, 112) of socks (10, 110), particularly tube socks.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A sock positionable over a leg, a heel and a foot, the sock comprising:

a leg section, an ankle section, and a foot section;

the leg section connected with the ankle section at an ankle section first end;

the foot section connected with the ankle section at an ankle section second end;

the foot section having a toe section opposite the ankle section second end;

the ankle section having a heel section positioned between the ankle section first end and the ankle section second end, wherein the heel section is configured to house at least one of the leg or the foot, wherein the leg section, foot section, and ankle section are made of the same material as the heel section;

an elastic material in seamed communication with the sock at the heel section by stitching;

the elastic material defining an annular perimeter about the heel section in close proximity to the heel; and wherein the elastic material provides for a compressive force about the annular perimeter and the compressive force impedes a downward travel of the leg section.

2. The sock of claim 1, further comprising the annular perimeter is at least one of a continuous perimeter or a discontinuous perimeter.

3. The sock of claim 1, further comprising the at least one elastic material comprising at least one of a first region of compressive force or a second region of compressive force.

4. The sock of claim 1, further comprising the annular perimeter connected with the heel and a foot section bottom.

5. The sock of claim 1, further comprising the at least one elastic material in at least one of affixed or removably connected with the sock.

6. A method of using a sock positionable over a leg, a heel and a foot, the sock having:

a leg section, an ankle section, and a foot section;

the leg section connected with the ankle section at an ankle section first end;

the foot section connected with the ankle section at an ankle section second end;

the ankle section having a heel section positioned between the ankle section first end and the ankle section second end;

wherein the leg section, the foot section, and the ankle section are made of the same material as the heel section;

an elastic material in seamed communication with the sock at the heel section by stitching;

the method comprising:

the elastic material defining an annular perimeter about the heel section in close proximity to the heel;

the elastic material placing a compressive force about the annular perimeter;

the leg section traveling in a direction of the heel section; and the elastic material impeding a downward travel of the leg section.

7. The method of claim 6, further comprising the leg section traveling down a body appendage in the direction of the heel section.

8. The method of claim 6, further comprising the leg section ceasing the downward travel.

9. The method of claim 6, further comprising placing the body appendage in the sock, wherein the heel section is configured to house at least one of the leg or the foot.

10. The method of claim 6, further comprising the impeding the downward travel of the leg section in close proximity to the heel section.

* * * * *